US012582210B2

(12) United States Patent
Deng

(10) Patent No.: US 12,582,210 B2
(45) Date of Patent: Mar. 24, 2026

(54) NAIL TIP FOR NAIL ART

(71) Applicant: GUANGZHOU BENYUAN INFORMATION TECHNOLOGY CO., LTD., Guangzhou (CN)

(72) Inventor: Yi Deng, Guangzhou (CN)

(73) Assignee: GUANGZHOU BENYUAN INFORMATION TECHNOLOGY CO., LTD., Guangzhou (CN)

( * ) Notice: Subject to any disclaimer, the term of this patent is extended or adjusted under 35 U.S.C. 154(b) by 320 days.

(21) Appl. No.: 18/303,581

(22) Filed: Apr. 20, 2023

(65) Prior Publication Data

US 2024/0122329 A1 Apr. 18, 2024

Related U.S. Application Data

(63) Continuation of application No. PCT/CN2023/080345, filed on Mar. 8, 2023.

(30) Foreign Application Priority Data

Oct. 12, 2022 (CN) ..... 202211246520.1

(51) Int. Cl.
*A45D 29/00* (2006.01)

(52) U.S. Cl.
CPC ..... *A45D 29/00* (2013.01)

(58) Field of Classification Search
CPC .... A45D 29/00; A45D 29/001; A45D 29/004; A45D 2029/002; A45D 2029/005; A45D 2029/008; A45D 31/00; A45D 2031/005
See application file for complete search history.

(56) References Cited

U.S. PATENT DOCUMENTS 4,346,720 A * 8/1982 Hokama ..... A45D 31/00 132/73
4,751,935 A * 6/1988 Mast ..... A61Q 3/00 132/73

(Continued)

FOREIGN PATENT DOCUMENTS

CN 101961166 A 2/2011
CN 114375168 A 4/2022

(Continued)

OTHER PUBLICATIONS

JP 2010035830 A. Translated document (Year: 2010).*
International search report of PCT patent application No. PCT/CN2023/080345 issued on Apr. 28, 2023.

*Primary Examiner* — Rachel R Steitz
*Assistant Examiner* — Karim Asqiriba
(74) *Attorney, Agent, or Firm* — Andrew C. Cheng

(57) ABSTRACT

The invention relates to the field of nail art, and particularly relates to a nail tip for nail art. The nail tip comprises a nail tip body with an outer surface being arched outwardly and a back surface being concaved inwardly, and any one left-right cross section from a rear end to a front end of the nail tip body becomes thinner from the middle to two sides. When applied to a nail, the nail tip makes the nail look stereoscopic, plump and beautiful; and the gap formed between the nail tip and the nail is small, so it is unnecessary to inject too much glue into the gap, and the nail tip is unlikely to fall from the nail.

20 Claims, 4 Drawing Sheets

(56) References Cited

U.S. PATENT DOCUMENTS

| | | | | | |
|---|---|---|---|---|---|
| 5,450,864 | A * | 9/1995 | LaJoie | A45D 31/00 | 132/73 |
| 5,513,664 | A * | 5/1996 | Krupsky | A45D 31/00 | 132/73 |
| 5,791,482 | A * | 8/1998 | Murphy | B65D 75/367 | 132/73 |
| 5,816,408 | A * | 10/1998 | Indelicato | B65D 25/10 | 206/581 |
| 5,860,429 | A * | 1/1999 | Chang | A45D 31/00 | 132/73 |
| 8,210,185 | B2 * | 7/2012 | Fracassi | A45D 31/00 | 132/73 |
| 12,089,714 | B2 * | 9/2024 | Chen | C08L 33/08 | |
| 12,207,720 | B1 * | 1/2025 | Cai | A45D 31/00 | |
| 2008/0289646 | A1 * | 11/2008 | Fracassi | A45D 31/00 | 132/73 |
| 2014/0183769 | A1 * | 7/2014 | Li | B29C 51/46 | 264/40.1 |
| 2016/0029767 | A1 * | 2/2016 | Han | A45D 31/00 | 132/73 |
| 2021/0093066 | A1 * | 4/2021 | Ma | A45D 31/00 | |
| 2022/0295965 | A1 * | 9/2022 | Hoang | A45D 31/00 | |
| 2024/0122329 | A1 * | 4/2024 | Deng | A45D 29/00 | |
| 2024/0341444 | A1 * | 10/2024 | Cushen | A45D 31/00 | |
| 2024/0358135 | A1 * | 10/2024 | Chen | C08L 33/08 | |
| 2024/0389731 | A1 * | 11/2024 | Ma | A45D 31/00 | |
| 2024/0415263 | A1 * | 12/2024 | Um | A45D 31/00 | |

FOREIGN PATENT DOCUMENTS

| | | | | |
|---|---|---|---|---|
| CN | 115517446 | A | | 12/2022 |
| JP | 2010035830 | A | * | 2/2010 |
| WO | 2012144406 | A1 | | 10/2012 |

* cited by examiner

NAIL TIP FOR NAIL ART

FIELD

The invention relates to the field of nail art, and particularly relates to a nail tip for nail art.

BACKGROUND

At present, nail art is done commonly in the following way: first, an operator applies a proper amount of glue on the surface of a nail to be beautified; then, an artificial nail tip of a suitable size is selected and placed on the glue on the surface of the nail; next, the outer surface of the artificial nail tip is moderately pressed to cling to the glue; and after the glue becomes solid and sets hard, the artificial nail tip is firmly adhered to the nail, and the nail art is finished. Existing artificial nail tips have a uniform thickness and the contour curvature of the front and back surfaces of the existing artificial nail tips is large, so when such artificial nail tips are applied to nails, the nails look more stereoscopic and plumper, thus being extremely beautiful. However, due to the fact that the contour curvatures of the nails of different people are different, that is, the contours of the nails may be slightly convex, flat or concave, a gap formed between the back surface of the artificial nail tip and the surface of the nail after the artificial nail tip is applied to the nail will become larger with the increase of the difference between the contour curvature of the back surface of the artificial nail tip and the contour curvature of the surface of the nail, and the operator has to apply more glue to fill in the gap to ensure that the artificial nail tip can be adhered to the surface of the nail. The adhesive force of the glue is mainly affected by the contact area, and the area, where glue can be applied, of the nail is fixed, so the adhesive force of the glue is basically unchanged after being applied to the surface of the nail. If the gap between the back surface of the artificial nail tip and the surface of the nail becomes larger, more glue has to be applied, and the weight of a glue layer formed after the glue is solidified will be greater, and under the condition that the adhesive force of the glue remains unchanged, the glue layer with a greater weight is more likely to fall from the surface of the nail, leading to a fall of the artificial nail tip.

SUMMARY

The technical issue to be settled by the invention is to provide a nail tip for nail art, which, when applied to a nail, makes the nail look stereoscopic, plump and beautiful; and when the nail tip is applied to the nail, the gap formed between the nail tip and the nail is small, so it is unnecessary to inject too much glue into the gap, and the nail tip for nail art is unlikely to fall from the nail.

The present invention provides a nail tip for nail art which comprises a nail tip body with an outer surface being arched outwardly and a back surface being concaved inwardly. Any one of left-right cross sections from a rear end to a front end of the nail tip body becomes thinner from a middle to two sides.

Preferably, the whole nail tip is bilaterally symmetric in shape, and the any one of the left-right cross sections is bilaterally symmetric.

Preferably, a front-rear longitudinal section passing through a central axis of the nail tip body has a thickest position located on a rear half, and the front-rear longitudinal section becomes thinner gradually from the thickest position to the front and rear ends of the nail tip body.

Preferably, a frontmost end of the nail tip body is thicker than a rearmost end of the nail tip body.

Preferably, a total length of the nail tip body in a front-rear direction is 17.00 mm-35.00 mm, and a vertex of the nail tip body is located at the thickest position of the front-rear longitudinal section, and is located at 26.0%-43.5% of the total length of the nail tip body from back to front.

Preferably, a center of gravity of the nail tip body is located at the thickest position of the front-rear longitudinal section, such that after the nail tip is adhered to a surface of a nail, a force bearing point of the nail tip is located on the nail.

Preferably, the vertex and the center of gravity are both located at the thickest position of the front-rear longitudinal section, and the center of gravity is located right below the vertex.

Preferably, a peripheral edge of the nail tip body becomes thicker gradually from back to front.

Preferably, a thickness of a rear edge of the peripheral edge of the nail tip body is 1.10 mm-0.35 mm, and a thickness of a front end of the peripheral edge of the nail tip body is 0.55 mm-0.75 mm.

Preferably, the thickness of the rear edge of the peripheral edge of the nail tip body is 1.13 mm-0.25 mm, and the thickness of the front end of the peripheral edge of the nail tip body is 0.60 mm-0.66 mm.

Preferably, a thickness of a thinnest position of the nail tip body is greater than 0.10 mm.

Preferably, a thickness of a thickest position of the nail tip body is less than 2.50 mm.

Preferably, the thickness of the thickest position of the nail tip body is 5.5-17.5 times that of the thinnest position of the nail tip body.

The present invention has the following beneficial effects: any one left-right cross section of the nail tip body of the nail tip for nail art becomes thinner from the middle to two sides, and the outer surface of the nail tip body is arched and the back surface of the nail tip body is concaved, that is, the curvature of the outer surface of the nail tip is large and the curvature of the back surface of the nail tip is small, so no matter whether the nails of users are slightly convex, flat or concave, after the nail tip is applied to the surface of a nail, the outer surface with the large curvature looks stereoscopic, plump and beautiful, and the back surface with the small curvature better fits the surface of the nail than the nail tips in the prior art; and the gap formed between the nail tip and the nail is small, so it is unnecessary to inject too much glue into the gap, and the nail tip is unlikely to fall from the nail.

REFERENCE SIGNS

1, nail tip body; X, thinnest position of the nail tip body; D, thickest position of the nail tip body; 2, outer surface; 21, edge line on the outer surface of the nail tip body; 3, back surface; 31, edge line on the back surface of the nail tip body; 4, rear end; 5, front end; 6, vertex; 7, edge; 71, rear edge; 72, front edge; H, left-right cross section; P, central axis; Z, front-rear longitudinal section passing through the central axis of the nail tip body.

DESCRIPTION OF THE EMBODIMENTS

The invention will be described in further detail below in conjunction with specific embodiments.

Embodiment 1

Figure 1:
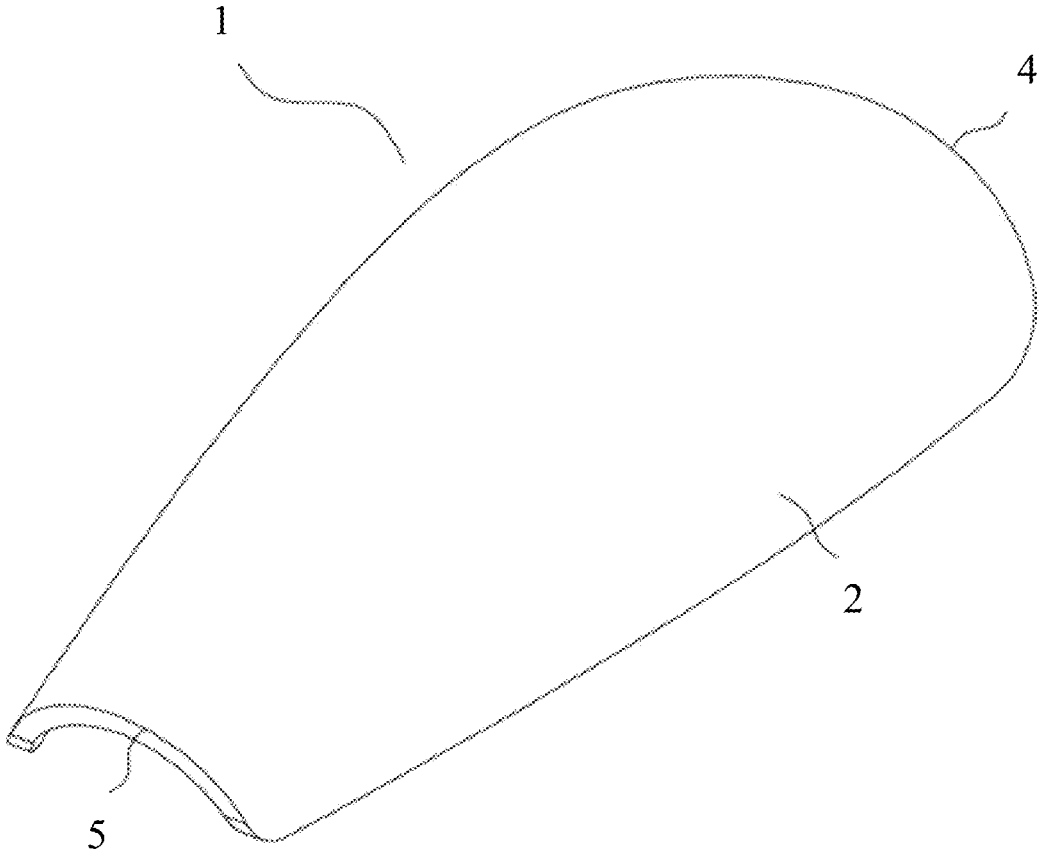
FIG. 1 is a structural diagram of the outer surface of a nail tip for nail art.
Figure 2:
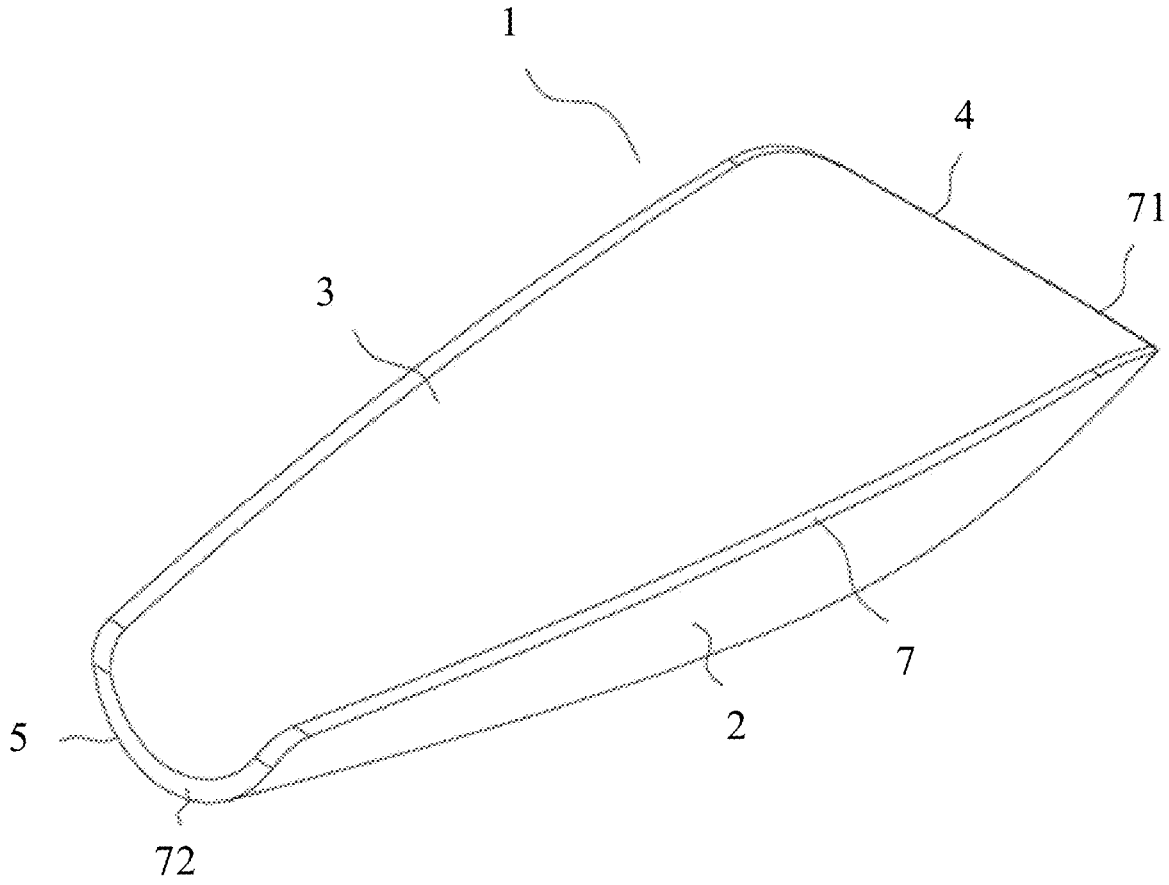
FIG. 2 is a structural diagram of the back surface of the nail tip for nail art.

As shown in FIG. 1 and FIG. 2, a nail tip for nail art comprises a nail tip body 1, wherein an outer surface 2 of the nail tip body 1 is arched outwardly, a back surface 3 of the nail tip body 1 is concaved, a rear end 4 of the nail tip body 1 is wide, and a front end 5 of the nail tip body 5 is narrow. A back surface of the rear end 4 of the nail tip body 1 is configured to be pasted on the surface of a nail of a person with the front end 5 of the nail tip body 1 extending beyond the fingertip. The total length of the nail tip body 1 in the front-rear direction is 34.54 mm, the thickness of a thinnest position X (shown in FIG. 4) is 0.25 mm, the thickness of a thickest position D (shown in FIG. 4) of the nail tip body 1 is 2.46 mm, and the thickness of the thickest position D is 9.8 times that of the thinnest position X. The whole nail tip body 1 is bilaterally symmetric in shape, and any one left-right cross section of the nail tip body 1 from the rear end 4 to the front end 5 is bilaterally symmetric. For example, the left-right cross section H in FIG. 5 becomes thinner from the middle to two sides, that is, the curvature of the outer surface 2 of the nail tip for nail art is large while the curvature of the back surface 3 of the nail tip is small, so after the nail tip for nail art is adhered to the nail, the outer surface 2 with the large curvature looks stereoscopic, plump and beautiful, the back surface 3 with the small curvature fits the surface of the nail, and a small gap is formed between the back surface 3 of the nail tip and the nail, so it is unnecessary to inject too much glue into the gap, and the nail tip is unlikely to fall from the nail.

Figure 3:
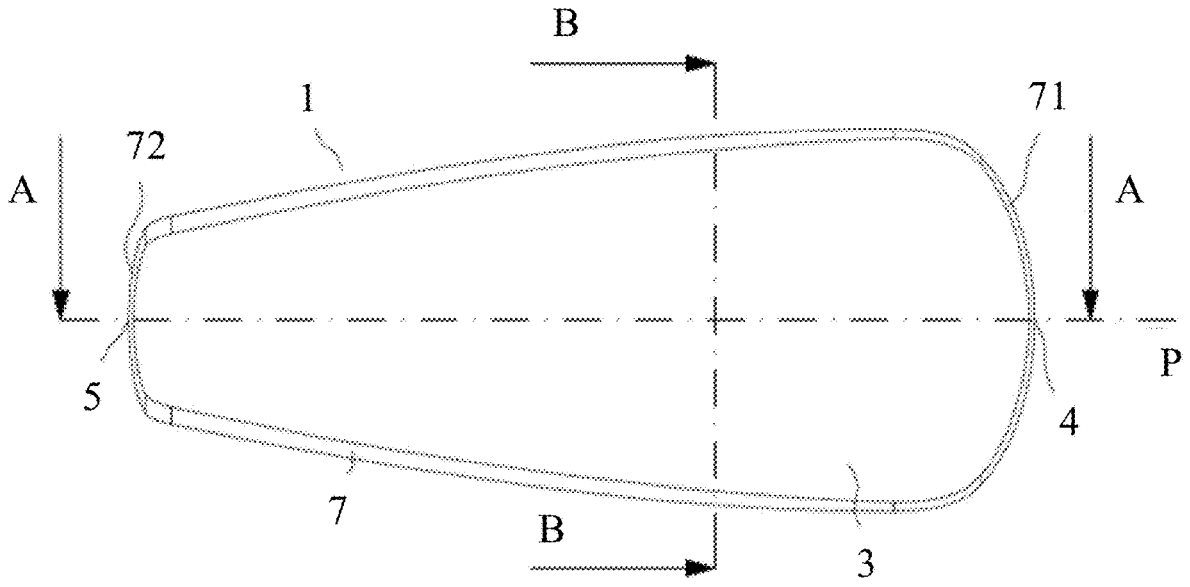
FIG. 3 is a bottom view of the nail tip for nail art.
Figure 4:
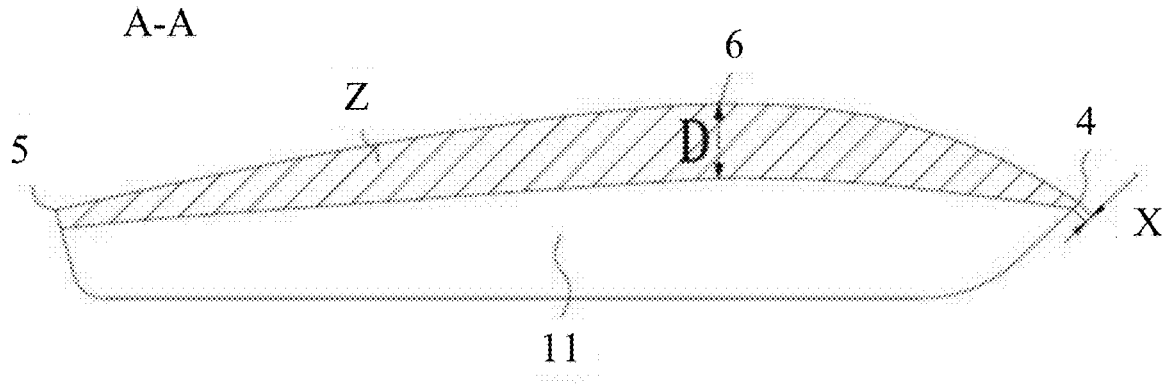
FIG. 4 is a sectional view taken along line A-A in FIG. 3.
Figure 5:
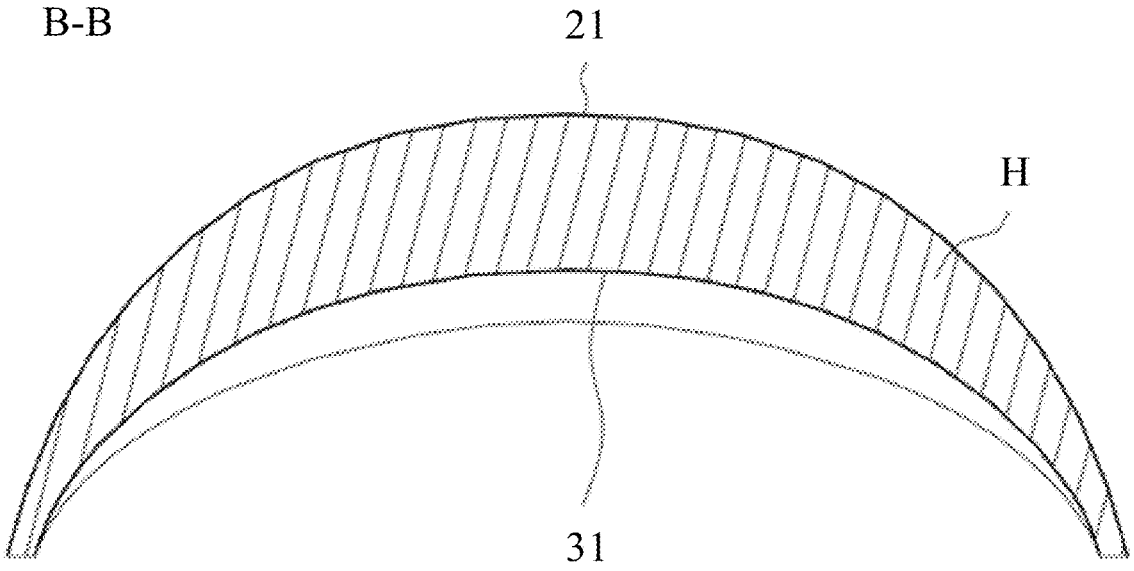
FIG. 5 is a sectional view taken along line B-B in FIG. 3.

As shown in FIG. 3 and FIG. 4, a front-rear longitudinal section Z passing through a central axis P of the nail tip body 1 has a thickest position located on a rear half, and becomes thinner gradually from the thickest position to the front and back ends 4 and 5 of the nail tip body 1. Front-rear longitudinal sections not passing through the central axis P of the nail tip body 1 are similar in structure with the front-rear longitudinal section Z, that is, they have a thickest position located on the rear half and become thinner gradually from the thickest position to the front and back ends 4 and 5 of the nail tip body 1. A vertex 6 of the nail tip body 1 is located at the thickest position of the front-rear longitudinal section Z passing through the central axis P, and the distance from the vertex 6 of the nail tip body 1 to the rear end 4 of the nail tip body 1 is 11.44 mm, that is, the vertex 6 of the nail tip body 1 is located at 33.1% of the total length of the nail tip body 1 from back to front. Because the left-right cross section H of the nail tip body 1 becomes thinner from the middle to two sides and the thickest position of the front-rear longitudinal section Z is located on the rear half, a center of gravity of the nail tip body 1 is located at the thickest position of the front-rear longitudinal section Z and is located right below the vertex, the center of gravity of the nail tip is aligned with the nail after the nail tip for nail art is adhered to the surface of the nail, and the force bearing point of the nail tip for nail art is located on the nail after being adhered to the surface of the nail, and the nail tip is stressed more uniformly and is unlikely to fall from the nail.

As shown in FIG. 2 and FIG. 3, a peripheral edge of the nail tip body 1 becomes thicker gradually from a rear edge 71 to a front edge 72, the thickness of the rear edge 71 of the nail tip body 1 is 0.25 mm, and the thickness of the front edge 72 of the nail tip body 1 is 0.60 mm. The front portion of the nail tip body 1 is thick, thus being rigid enough and unlikely to be worn or fractured; the rear portion of the nail tip body 1 is thin, thus being highly ductile and better fitting the shape of the surface of the nail after being adhered to the surface of the nail.

Embodiment 2

The nail tip for nail art in this embodiment is identical in structure with the nail tip in Embodiment 1, and differs from the nail tip in Embodiment 1 in the following dimension values: the total length of the nail tip body 1 in the front-rear direction is 30.92 mm, the distance from the vertex 6 to the rear end 4 of the nail tip body 1 is 9.41 mm, and the vertex 6 is located at 30.4% of the total length of the nail tip body 1; the thickness of the thinnest position X of the nail tip body 1 is 0.13 mm, the thickness of the thickest position D of the nail tip body 1 is 2.20 mm, and the thickness of the thickest position D is 16.9 times that of the thinnest position X; and the thickness of the rear edge 71 of the nail tip body 1 is 0.13 mm, and the thickness of the front edge 72 of the nail tip body 1 is 0.60 mm.

Embodiment 3

The nail tip for nail art in this embodiment is identical in structure with the nail tip in Embodiment 1, and differs from the nail tip in Embodiment 1 in the following dimension values: the total length of the nail tip body 1 in the front-rear direction is 27.50 mm, the distance from the vertex 6 to the rear end 4 of the nail tip body 1 is 7.30 mm, and the vertex 6 is located at 26.5% of the total length of the nail tip body 1; the thickness of the thinnest position X of the nail tip body 1 is 0.13 mm, the thickness of the thickest position D of the nail tip body 1 is 1.74 mm, and the thickness of the thickest position D is 13.4 times that of the thinnest position X; and the thickness of the rear edge 71 of the nail tip body 1 is 0.13 mm, and the thickness of the front edge 72 of the nail tip body 1 is 0.60 mm.

Embodiment 4

The nail tip for nail art in this embodiment is identical in structure with the nail tip in Embodiment 1, and differs from the nail tip in Embodiment 1 in the following dimension values: the total length of the nail tip body 1 in the front-rear direction is 25.87 mm, the distance from the vertex 6 to the rear end 4 of the nail tip body 1 is 7.50 mm, and the vertex 6 is located at 29.0% of the total length of the nail tip body 1; the thickness of the thinnest position X of the nail tip body 1 is 0.17 mm, the thickness of the thickest position D of the nail tip body 1 is 1.39 mm, and the thickness of the thickest position D is 8.2 times that of the thinnest position X; and the thickness of the rear edge 71 of the nail tip body 1 is 0.17 mm, and the thickness of the front edge 72 of the nail tip body 1 is 0.60 mm.

Embodiment 5

The nail tip for nail art in this embodiment is identical in structure with the nail tip in Embodiment 1, and differs from the nail tip in Embodiment 1 in the following dimension values: the total length of the nail tip body 1 in the front-rear direction is 25.30 mm, the distance from the vertex 6 to the rear end 4 of the nail tip body 1 is 7.80 mm, and the vertex 6 is located at 30.8% of the total length of the nail tip body 1; the thickness of the thinnest position X of the nail tip body 1 is 0.21 mm, the thickness of the thickest position D of the nail tip body 1 is 1.80 mm, and the thickness of the thickest position D is 8.6 times that of the thinnest position X; and the thickness of the rear edge 71 of the nail tip body 1 is 0.21 mm, and the thickness of the front edge 72 of the nail tip body 1 is 0.64 mm.

Embodiment 6

The nail tip for nail art in this embodiment is identical in structure with the nail tip in Embodiment 1, and differs from the nail tip in Embodiment 1 in the following dimension values: the total length of the nail tip body 1 in the front-rear direction is 24.30 mm, the distance from the vertex 6 to the rear end 4 of the nail tip body 1 is 7.70 mm, and the vertex 6 is located at 31.7% of the total length of the nail tip body 1; the thickness of the thinnest position X of the nail tip body 1 is 0.21 mm, the thickness of the thickest position D of the nail tip body 1 is 1.74 mm, and the thickness of the thickest position D is 8.3 times that of the thinnest position X; and the thickness of the rear edge 71 of the nail tip body 1 is 0.21 mm, and the thickness of the front edge 72 of the nail tip body 1 is 0.66 mm.

Embodiment 7

The nail tip for nail art in this embodiment is identical in structure with the nail tip in Embodiment 1, and differs from the nail tip in Embodiment 1 in the following dimension values: the total length of the nail tip body 1 in the front-rear direction is 22.80 mm, the distance from the vertex 6 to the rear end 4 of the nail tip body 1 is 7.60 mm, and the vertex 6 is located at 33.3% of the total length of the nail tip body 1; the thickness of the thinnest position X of the nail tip body 1 is 0.23 mm, the thickness of the thickest position D of the nail tip body 1 is 1.61 mm, and the thickness of the thickest position D is 7.0 times that of the thinnest position X; and the thickness of the rear edge 71 of the nail tip body 1 is 0.23 mm, and the thickness of the front edge 72 of the nail tip body 1 is 0.66 mm.

Embodiment 8

The nail tip for nail art in this embodiment is identical in structure with the nail tip in Embodiment 1, and differs from the nail tip in Embodiment 1 in the following dimension values: the total length of the nail tip body 1 in the front-rear direction is 20.50 mm, the distance from the vertex 6 to the rear end 4 of the nail tip body 1 is 7.30 mm, and the vertex 6 is located at 35.6% of the total length of the nail tip body 1; the thickness of the thinnest position X of the nail tip body 1 is 0.23 mm, the thickness of the thickest position D of the nail tip body 1 is 1.40 mm, and the thickness of the thickest position D is 6.1 times that of the thinnest position X; and the thickness of the rear edge 71 of the nail tip body 1 is 0.23 mm, and the thickness of the front edge 72 of the nail tip body 1 is 0.66 mm.

Embodiment 9

The nail tip for nail art in this embodiment is identical in structure with the nail tip in Embodiment 1, and differs from the nail tip in Embodiment 1 in the following dimension values: the total length of the nail tip body 1 in the front-rear direction is 21.20 mm, the distance from the vertex 6 to the rear end 4 of the nail tip body 1 is 8.00 mm, and the vertex 6 is located at 37.7% of the total length of the nail tip body 1; the thickness of the thinnest position X of the nail tip body 1 is 0.21 mm, the thickness of the thickest position D of the nail tip body 1 is 1.85 mm, and the thickness of the thickest position D is 8.8 times that of the thinnest position X; and the thickness of the rear edge 71 of the nail tip body 1 is 0.21 mm, and the thickness of the front edge 72 of the nail tip body 1 is 0.65 mm.

Embodiment 10

The nail tip for nail art in this embodiment is identical in structure with the nail tip in Embodiment 1, and differs from the nail tip in Embodiment 1 in the following dimension values: the total length of the nail tip body 1 in the front-rear direction is 18.90 mm, the distance from the vertex 6 to the rear end 4 of the nail tip body 1 is 7.70 mm, and the vertex 6 is located at 40.7% of the total length of the nail tip body 1; the thickness of the thinnest position X of the nail tip body 1 is 0.22 mm, the thickness of the thickest position D of the nail tip body 1 is 1.701 mm, and the thickness of the thickest position D is 7.7 times that of the thinnest position X; and the thickness of the rear edge 71 of the nail tip body 1 is 0.22 mm, and the thickness of the front edge 72 of the nail tip body 1 is 0.65 mm.

Embodiment 11

The nail tip for nail art in this embodiment is identical in structure with the nail tip in Embodiment 1, and differs from the nail tip in Embodiment 1 in the following dimension values: the total length of the nail tip body 1 in the front-rear direction is 17.85 mm, the distance from the vertex 6 to the rear end 4 of the nail tip body 1 is 7.50 mm, and the vertex 6 is located at 42.0% of the total length of the nail tip body 1; the thickness of the thinnest position X of the nail tip body 1 is 0.23 mm, the thickness of the thickest position D of the nail tip body 1 is 1.55 mm, and the thickness of the thickest position D is 6.7 times that of the thinnest position X; and the thickness of the rear edge 71 of the nail tip body 1 is 0.23 mm, and the thickness of the front edge 72 of the nail tip body 1 is 0.66 mm.

Embodiment 12

The nail tip for nail art in this embodiment is identical in structure with the nail tip in Embodiment 1, and differs from the nail tip in Embodiment 1 in the following dimension values: the total length of the nail tip body 1 in the front-rear direction is 17.00 mm, the distance from the vertex 6 to the rear end 4 of the nail tip body 1 is 7.30 mm, and the vertex 6 is located at 42.9% of the total length of the nail tip body 1; the thickness of the thinnest position X of the nail tip body 1 is 0.24 mm, the thickness of the thickest position D of the nail tip body 1 is 1.40 mm, and the thickness of the thickest position D is 5.8 times that of the thinnest position X; and the thickness of the rear edge 71 of the nail tip body 1 is 0.24 mm, and the thickness of the front edge 72 of the nail tip body 1 is 0.65 mm.

Thus, the total length of the nail tip body 1 of the nail tip in the front-rear direction may be 17.00 mm-35.00 mm, and the vertex 6 is closed to the rear end 4 of the nail tip body 1 and may be located at 26.0%-43.5%, preferably 26.5%-

42.9%, of the total length of the nail tip body 1; the thickness of the thinnest position of the nail tip body 1 is greater than 0.10 mm and/or the thickness of the thickest position of the nail tip body 1 is less than 2.50 mm, and preferably, the thickness of the thickest position D is 5.5-17.5 times that of the thinnest position X; the thickness of the rear edge 71 of the nail tip body 1 may be 0.10 mm-0.75 mm, preferably 0.13 mm-0.25 mm; and the thickness of the front edge 72 of the nail tip body 1 may be 0.55 mm-0.75 mm, preferably 0.60 mm-0.66 mm.

The above description is merely used to explain the embodiments of the invention, and is not intended to limit the patent protection scope of the invention. All insubstantial transformations or substitutions made by those skilled in the art based on the invention still fall within the patent protection scope of the invention.

What is claimed is:

1. A nail tip for nail art, comprising a nail tip body with an outer surface being arched and a back surface being concaved, wherein any one of left-right cross sections from a rear end to a front end of the nail tip body becomes thinner from a middle to two sides; a front-rear longitudinal section passing through a central axis of the nail tip body has a thickest position located on a rear half, the front-rear longitudinal section becomes thinner gradually from the thickest position to the front and rear ends of the nail tip body; a total length of the nail tip body in a front-rear direction is 17.00 mm~35.00 mm, a vertex of the nail tip body is located at the thickest position of the front-rear longitudinal section; and the rear half is located on a nail after the nail tip for nail art being adhered to a surface of the nail.

2. The nail tip for nail art according to claim 1, wherein a whole nail tip is bilaterally symmetric in shape, and the any one of the left-right cross sections is bilaterally symmetric.

3. The nail tip for nail art according to claim 1, wherein a frontmost end of the nail tip body is thicker than a rearmost end of the nail tip body.

4. The nail tip for nail art according to claim 1, wherein the vertex of the nail tip body is located at 26.0%-43.5% of the total length of the nail tip body from the rear end to the front end.

5. The nail tip for nail art according to claim 4, wherein a center of gravity of the nail tip body is located at the thickest position of the front-rear longitudinal section, such that after the nail tip is adhered to the surface of the nail, a force bearing point of the nail tip is located on the nail.

6. The nail tip for nail art according to claim 5, wherein the vertex and the center of gravity are both located at the thickest position of the front-rear longitudinal section, and the center of gravity is located right below the vertex.

7. The nail tip for nail art according to claim 1, wherein a peripheral edge of the nail tip body becomes thicker gradually from the rear end to the front end.

8. The nail tip for nail art according to claim 7, wherein a thickness of a rear edge of the peripheral edge of the nail tip body is 0.10 mm-0.75 mm, and a thickness of a front end of the peripheral edge of the nail tip body is 0.55 mm-0.75 mm.

9. The nail tip for nail art according to claim 8, wherein the thickness of the rear edge of the peripheral edge of the nail tip body is 0.13 mm-0.25 mm, and the thickness of the front end of the peripheral edge of the nail tip body is 0.60 mm-0.66 mm.

10. The nail tip for nail art according to claim 1, wherein a thickness of a thinnest position of the nail tip body is greater than 0.10 mm.

11. The nail tip for nail art according to claim 10, wherein a thickness of the thickest position of the nail tip body is less than 2.50 mm.

12. The nail tip for nail art according to claim 11, wherein the thickness of the thickest position of the nail tip body is 5.5-17.5 times that of the thinnest position of the nail tip body.

13. The nail tip for nail art according to claim 1, wherein a thickness of the thickest position of the nail tip body is less than 2.50 mm.

14. A nail tip for nail art, comprising a nail tip body with an outer surface being arched and a back surface being concaved, wherein a front-rear longitudinal section passing through a central axis of the nail tip body has a thickest position located on a rear half that is to be adhered to a surface of a nail, the front-rear longitudinal section becomes thinner gradually from the thickest position to the front and rear ends of the nail tip body; and a center of gravity of the nail tip body is located on the rear half.

15. The nail tip for nail art according to claim 14, wherein the center of gravity of the nail tip body is located at the thickest position of the front-rear longitudinal section.

16. The nail tip for nail art according to claim 15, wherein a vertex of the nail tip body is located at the rear half.

17. The nail tip for nail art according to claim 16, wherein the vertex is located at the thickest position of the front-rear longitudinal section, and the center of gravity is located right below the vertex.

18. The nail tip for nail art according to claim 16, wherein a total length of the nail tip body in a front-rear direction is 17.00 mm~35.00 mm, and the vertex is located at 26.0%-43.5% of the total length of the nail tip body from the rear end to the front end.

19. The nail tip for nail art according to claim 14, wherein a frontmost end of the nail tip body is thicker than a rearmost end of the nail tip body, and a thickness of the thickest position of the nail tip body is 5.5-17.5 times that of a thinnest position of the nail tip body.

20. The nail tip for nail art according to claim 14, wherein any one of left-right cross sections from a rear end to a front end of the nail tip body becomes thinner from a middle to two sides.

* * * * *